US010126038B2

(12) United States Patent
Tao et al.

(10) Patent No.: US 10,126,038 B2
(45) Date of Patent: Nov. 13, 2018

(54) REFRIGERATOR

(71) Applicants: QINGDAO HAIER REFRIGERATOR CO., LTD., Qingdao, Shandong Province (CN); QINGDAO HAIER JOINT STOCK CO., LTD., Qingdao, Shandong Province (CN)

(72) Inventors: Haibo Tao, Qingdao (CN); Feifei Qi, Qingdao (CN); Lisheng Ji, Qingdao (CN); Jianru Liu, Qingdao (CN)

(73) Assignees: QINGDAO HAIER REFRIGERATOR CO., LTD., Qingdao, Shandong Province (CN); QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 15/547,513

(22) PCT Filed: Jun. 17, 2016

(86) PCT No.: PCT/CN2016/086184
§ 371 (c)(1),
(2) Date: Jul. 30, 2017

(87) PCT Pub. No.: WO2017/032148
PCT Pub. Date: Mar. 2, 2017

(65) Prior Publication Data

US 2018/0010842 A1 Jan. 11, 2018

(30) Foreign Application Priority Data

Aug. 26, 2015 (CN) ..... 2015 1 0534155

(51) Int. Cl.
*F25D 17/06* (2006.01)
*F25D 17/04* (2006.01)
(Continued)

(52) U.S. Cl.
CPC ..... *F25D 17/062* (2013.01); *F25D 17/045* (2013.01); *F25D 17/065* (2013.01);
(Continued)

(58) Field of Classification Search
CPC ..... F25D 17/04; F25D 17/042; F25D 17/045; F25D 17/06; F25D 17/062; F25D 17/065;
(Continued)

(56) References Cited

U.S. PATENT DOCUMENTS 7,644,590 B2 * 1/2010 Holmes ..... F25D 29/00 165/63
2012/0047922 A1 3/2012 Lee et al.
2014/0061201 A1 * 3/2014 Hernandez ..... F25D 25/025 220/529

FOREIGN PATENT DOCUMENTS

CN 101551189 A 10/2009
CN 102506539 A 6/2012
(Continued)

*Primary Examiner* — Cassey D Bauer
(74) *Attorney, Agent, or Firm* — Cheng-Ju Chiang

(57) ABSTRACT

The present invention provides a refrigerator, comprising a storage compartment and a mixed air passage. Both ends of the mixed air passage have air inlets, the middle portion of the mixed air passage comprises a mixed air outlet communicating with the storage compartment, and the mixed air passage is configured to receive air flows from the two air inlets such that two air flows enter the storage compartment in a mixed manner via the mixed air outlet. The refrigerator of this invention comprises a mixed air passage, so that the air in an area of the storage compartment with a relatively high temperature can enter the mixed air passage earlier than external air or the air in the storage compartment with a
(Continued)

relatively low temperature. Then, the two air flows are blown to the storage compartment in a mixed manner, realizing even temperature distribution in the storage compartment.

7 Claims, 2 Drawing Sheets

(51) Int. Cl.
*F25D 25/02* (2006.01)
*F25D 11/02* (2006.01)

(52) U.S. Cl.
CPC ..... *F25D 25/025* (2013.01); *F25D 11/022* (2013.01); *F25D 2317/06* (2013.01); *F25D 2317/061* (2013.01); *F25D 2317/0655* (2013.01); *F25D 2317/0665* (2013.01); *F25D 2400/28* (2013.01)

(58) Field of Classification Search
CPC ..... F25D 17/067; F25D 25/025; F25D 2317/061; F25D 2317/0666; F25D 2317/0665; F25D 2317/0671
See application file for complete search history.

(56) References Cited

FOREIGN PATENT DOCUMENTS

| | | | |
|---|---|---|---|
| CN | 202420084 | U | 9/2012 |
| CN | 102937355 | A | 2/2013 |
| CN | 105042989 | A | 11/2015 |
| CN | 105042994 | A | 11/2015 |
| CN | 204923644 | U | 12/2015 |
| CN | 204923645 | U | 12/2015 |

* cited by examiner

REFRIGERATOR

CROSS REFERENCE TO RELATED APPLICATIONS

The present application is a 35 U.S.C. § 371 National Phase conversion of International (PCT) Patent Application No. PCT/CN2016/086184, filed on Jun. 17, 2016, which claims benefit of Chinese patent application No. 201510534155.8 filed on Aug. 26, 2015, the disclosure of which is incorporated by reference herein. The PCT International Patent Application was filed and published in Chinese.

TECHNICAL FIELD

The present invention is related to the field of freezing and refrigeration technologies, and more particularly, to a refrigerator.

BACKGROUND

Air-cooled refrigerators can maintain the freshness of food, extend food storage time and improve food safety, so they become essential home appliances. However, in current air-cooled refrigerators, usually the air supply passage is arranged at the rear part of a storage compartment. After cooled air is blown, it sinks. As a result, the temperature at the front part of the storage compartment is relatively high, while the temperature at the rear part thereof is relatively low, causing uneven temperatures. The front part of the storage compartment is close to the door and heat leak can easily occur. Accordingly, the temperature at the front part of the storage compartment will be even higher, which is unfavorable for storing food. How to realize even temperature distribution in the storage compartment of a refrigerator is an urgent problem for improving the refrigeration effect of refrigerators.

SUMMARY

This invention aims to overcome at least one defect of existing refrigerators, and provides a novel refrigerator. The refrigerator can realize even temperature distribution in the storage compartment.

Accordingly, this invention provides a refrigerator, comprising a storage compartment. In particular, the refrigerator further comprises: a mixed air passage, whose both ends have air inlets, whose middle portion comprises a mixed air outlet communicating with the storage compartment, and which is configured to receive air flows from the two air inlets such that two air flows enter the storage compartment in a mixed manner via the mixed air outlet.

Optionally, the refrigerator further comprises a mixed air blower configured to blow the two air flows to the storage compartment in a mixed manner.

Optionally, the refrigerator further comprises a mixed air passage cover plate mounted at a top wall of the storage compartment to form the mixed air passage, wherein the mixed air passage extends longitudinally and comprises the air inlets at its front and rear ends.

Optionally, the mixed air passage cover plate is mounted on a lower surface of the top wall of the storage compartment, and comprises: a web portion extending upwards from a rear end of the web portion to a front end thereof and comprising a through hole at the center thereof, and an air aperture portion extending downwards in a direction perpendicular with the web portion from an edge of the through hole and having a lower end opening acting as the mixed air outlet.

Optionally, the mixed air blower is an axial blower and is mounted inside the air aperture portion.

Optionally, an included angle between the web portion and the horizontal plane is between 5 and 30 degrees.

Optionally, the refrigerator further comprises a drawer which is mounted inside the storage compartment and lower portions of whose front and rear walls comprise ventilation holes.

Optionally, the refrigerator further comprises a refrigeration air passage, wherein one air inlet of the mixed air passage is configured to receive a refrigeration air flow blown from the refrigeration air passage, and another air inlet of the mixed air passage communicates with the storage compartment.

Optionally, the refrigerator further comprises a refrigeration air passage cover plate mounted at a front surface of a rear wall of the storage compartment to form the refrigeration air passage, and provided with at least one rear air outlet; or a refrigeration air passage cover plate mounted at a rear surface of the rear wall of the storage compartment to form the refrigeration air passage, the rear wall of the storage compartment being provided with at least one rear air outlet, wherein the at least one rear air outlet is configured to blow the refrigeration air flow to the one air inlet of the mixed air passage and/or to the storage compartment, and the another air inlet of the mixed air passage communicates with a front space of the storage compartment.

Optionally, a lower portion of the rear wall of the storage compartment comprises a return air opening such that a part or all of the air in the storage compartment flows out of the storage compartment via the return air opening and enters the refrigeration air passage after being cooled.

The refrigerator of this invention comprises a mixed air passage, so that the air in an area of the storage compartment with a relatively high temperature can enter the mixed air passage earlier than external air or the air in the storage compartment with a relatively low temperature. Then, the two air flows are blown to the storage compartment in a mixed manner, realizing even temperature distribution in the storage compartment.

Further, the mixed air passage of the refrigerator of this invention can mix two air flows at different positions/of different temperatures in the storage compartment and blow the mixed air to the storage compartment, realizing even temperature distribution in the storage compartment. For example, the mixed air passage can mix the air of a relatively low temperature in the rear portion of the storage compartment with the air of a relatively high temperature in the front portion of the storage compartment, and blow the mixed air to the storage compartment.

Further, an air inlet of the mixed air passage of the refrigerator of this invention communicates with a refrigeration air passage of the refrigerator, so that refrigeration air can be first mixed with return air of a relatively high temperature in the storage compartment, then the mixed air is blown to the storage compartment, and the refrigeration output/temperature in the storage compartment is evenly distributed, realizing quick, even and efficient refrigeration. In addition, the mixed air passage enables the refrigeration air path in the storage compartment to change from a single circulation process to a multiple circulation process, realizing even temperature distribution in the storage compartment.

The above and other objects, advantages and features of the invention will be understood by those skilled in the art more clearly with reference to the detailed description of the embodiments of this invention below with reference to the accompanying drawings.

BRIEF DESCRIPTION OF THE DRAWINGS

The followings will describe some embodiments of this invention in detail in an exemplary rather than restrictive manner with reference to the accompanying drawings. The same reference signs in the drawings represent the same or similar parts. Those skilled in the art shall understand that these drawings are only schematic ones of this invention, and may not be necessarily drawn according to the scales. In the drawings.

DETAILED DESCRIPTION

Figure 1:
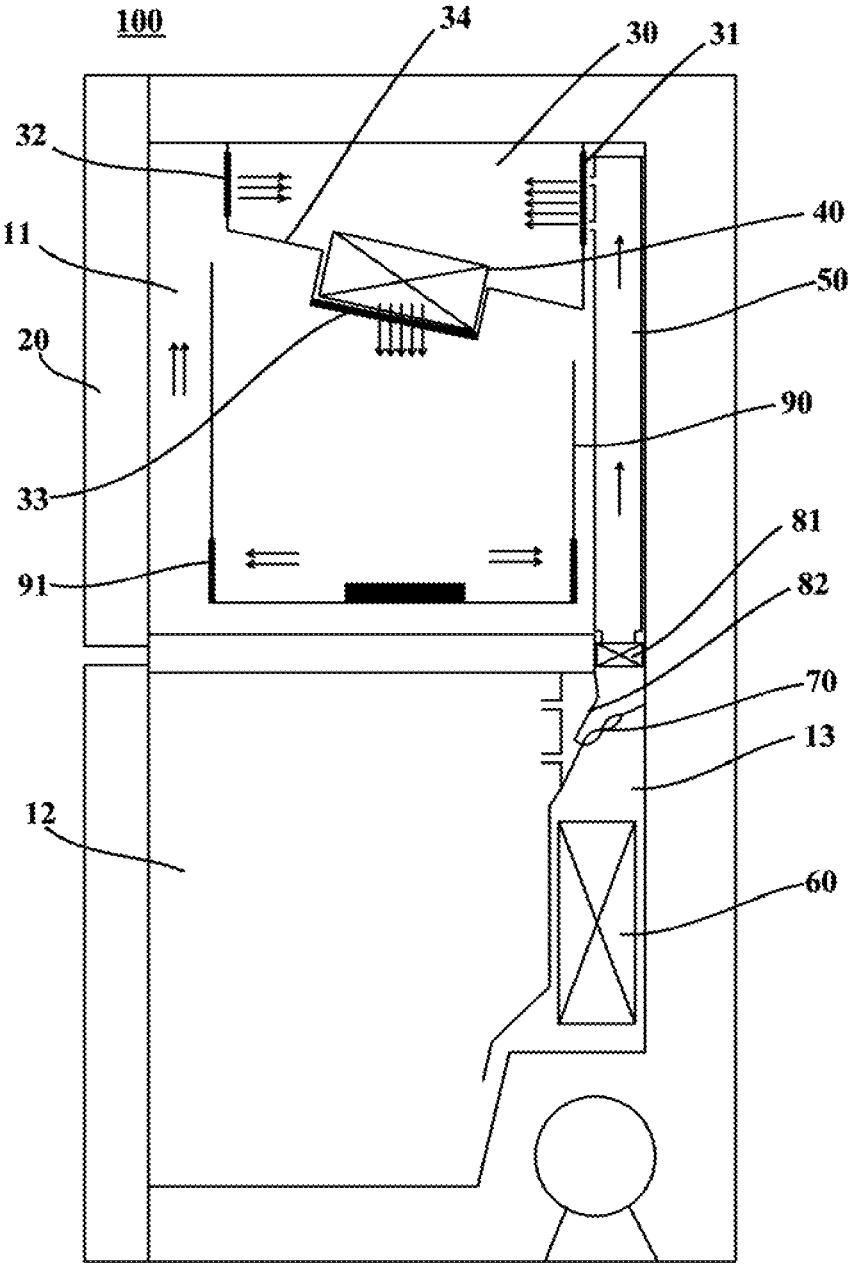
FIG. 1 is a schematic view of a refrigerator according to an embodiment of this invention.

FIG. 1 is a schematic view of a refrigerator 100 according to an embodiment of this invention. As shown in FIG. 1, the embodiment of this invention provides a refrigerator 100. The refrigerator 100 may typically comprise a storage compartment 11 for storing food and a door 20 for closing the storage compartment 11. In particular, the refrigerator 100 may further comprise: a mixed air passage 30, whose both ends have air inlets 31, 32, and whose middle portion comprises a mixed air outlet 33 communicating with the storage compartment 11. The mixed air passage 30 may be configured to receive air flows from the two air inlets 31, 32 such that two air flows enter the storage compartment 11 in a mixed manner via the mixed air outlet 33.

Further, in some embodiments, at least one air inlet, such as the air inlet 32, of the mixed air passage 30 communicates with the storage compartment 11. The other air inlet, such as the air inlet 31, may or may not communicate with the storage compartment 11. When the other air inlet does not communicate with the storage compartment, it may communicate with other air passages supplying air to the storage compartment 11. For example, both air inlets of the mixed air passage 30 may communicate with the storage compartment 11. In a typical refrigerator 100, a temperature at the front portion of the storage compartment 11 is usually higher than that in the rear portion thereof. One air inlet 31 of the mixed air passage 30 may receive rear return air from the rear portion of the storage compartment 11 of the refrigerator 100, and the other air inlet 32 of the mixed air passage 30 may receive front return air from the door 20 of the storage compartment 11 of the refrigerator 100. Then, the front and rear return air is mixed and blown to the storage compartment 11, realizing even temperature distribution in the storage compartment 11. In some alternative embodiments, both air inlets 31, 32 of the mixed air passage 30 may communicate with other two air passages supplying air to the storage compartment 11. For example, in a refrigerator having a compression refrigeration system and semiconductor refrigeration system, when refrigeration air is supplied to the storage compartment by the compression refrigeration system and the semiconductor refrigeration simultaneously, the two refrigeration air flows may be mixed before being blown to the storage compartment.

In some embodiments of this invention, the refrigerator 100 further comprises a mixed air blower 40 provided at the mixed air outlet 33 and configured to blow the two air flows to the storage compartment 11 in a mixed manner so as to improve the air supply efficiency. The mixed air blower 40 may be an axial blower. In some alternative embodiments of this invention, a blower may be provided at each air inlet of the mixed air passage 30 to blow air flows into the mixed air passage 30. In other alternative embodiments of this invention, each air inlet may directly receive air flows blown from other air passages.

In some preferred embodiments of this invention, the refrigerator 100 further comprises a mixed air passage cover plate 34 mounted at a top wall of the storage compartment 11 to form the mixed air passage 30, which may also be called a top air passage. The mixed air passage 30 extends longitudinally and comprises the air inlets 31, 32 at its front and rear ends. For example, the mixed air passage cover plate 34 may be mounted on a lower surface of the top wall of the storage compartment 11, and comprises: a web portion 341 comprising a through hole at the center thereof, and an air aperture portion 342. The web portion 341 extends upwards from a rear end of the web portion to a front end thereof, and an included angle between the web portion and the horizontal plane is between 5 and 30 degrees. The air aperture portion 342 extends downwards in a direction perpendicular with the web portion 341 from an edge of the through hole and has a lower end opening acting as the mixed air outlet 33. The mixed air outlet 33 is slightly inclined forwards, guaranteeing a low temperature environment at the door 20 of the refrigerator 100. The mixed air blower 40 is mounted inside the air aperture portion 342. Further, the refrigerator 100 may further comprise two end cover plates each provided with the air inlets 31, 32. The two end cover plates may be mounted at the two sides of the mixed air passage cover plate 34 respectively.

In some preferred embodiments of this invention, the refrigerator 100 further comprises a refrigeration air passage 50 for supplying refrigeration air. One air inlet 31 of the mixed air passage 30 is configured to receive a refrigeration air flow blown from the refrigeration air passage 50, and the other air inlet 32 of the mixed air passage 30 communicates with the storage compartment 11, so that refrigeration air flows from the refrigeration air passage 50 are mixed with the return air from the storage compartment 11 and having a relatively high temperature before being blown to the storage compartment 11. A lower portion of the rear wall of the storage compartment 11 comprises a return air opening such that a part or all of the air in the storage compartment 11 flows out of the storage compartment 11 via the return air opening and enters the refrigeration air passage 50 after being cooled. The passage connecting the return air opening and the cooling device is called a return air passage.

The refrigerator 100 of this invention may further comprise a refrigeration air passage cover plate mounted at a front surface of a rear wall of the storage compartment 11 to form the refrigeration air passage 50, and provided with at least one rear air outlet; or a refrigeration air passage cover plate mounted at a rear surface of the rear wall of the storage compartment 11 to form the refrigeration air passage 50, the rear wall of the storage compartment 11 being provided with at least one rear air outlet. The at least one rear air outlet is configured to blow the refrigeration air flow to the one air inlet 31 of the mixed air passage 30 and/or to the storage compartment 11, and the other air inlet 32 of the mixed air passage 30 communicates with a front space of the storage compartment 11.

For example, in some embodiments of this invention, the at least one rear air outlet is configured to blow the refrigeration air flow to the one air inlet 31 of the mixed air passage 30. That is, the refrigeration air flow from the refrigeration air passage 50 may be mixed with the return air from the storage compartment 11 and having a relatively high temperature before being blown to the storage compartment 11. Specifically, the surface on which the at least one rear air outlet is located abuts against the end surface of the air inlet 31 of the mixed air passage 30 to allow the refrigeration air to enter the mixed air passage 30. Alternatively, the surface on which the at least one rear air outlet is located may be spaced from the end surface of the air inlet 31 of the mixed air passage 30 by a predetermined clearance to allow the refrigeration air to enter the mixed air passage 30. The at least one rear air outlet and the air inlet 31 of the mixed air passage 30 are located inside the storage compartment 11. Alternatively, the mixed air passage cover plate 34 may be formed by extending a front surface of the refrigeration air passage cover plate forwards, so that the mixed air passage 30 and the refrigeration air passage 50 are integrally formed.

In other embodiments of this invention, the at least one rear air outlet is configured to blow the refrigeration air flow to the air inlet 31 of the mixed air passage 30 and to a rear space of the storage compartment 11 so as to improve the refrigeration speed of the refrigerator 100.

In some embodiments of this invention, to facilitate picking and placing of articles, the refrigerator 100 may further comprise a drawer 90 for receiving the articles 92, such as beef. The drawer 90 can be operably inserted into the storage compartment 11 and pulled out of the same. In other words, the drawer 90 is installed inside the storage compartment 11. Optionally, a lower part of the rear wall of the drawer 90 comprises ventilation holes 91, so that the air flow flowing out of the mixed air outlet 30 can easily flow out of the drawer 90 via the ventilation holes 91 of the drawer 90 after exchanging heat with the articles 92 inside the drawer 90. Further, the air flowing out of the ventilation holes 91 of the front end of the drawer 90 may return to the other air inlet 32 of the mixed air passage 30 for circulation. The air flowing out of the ventilation holes 91 of the rear end of the drawer 90 may return to the return air passage for circulation.

Figure 2:
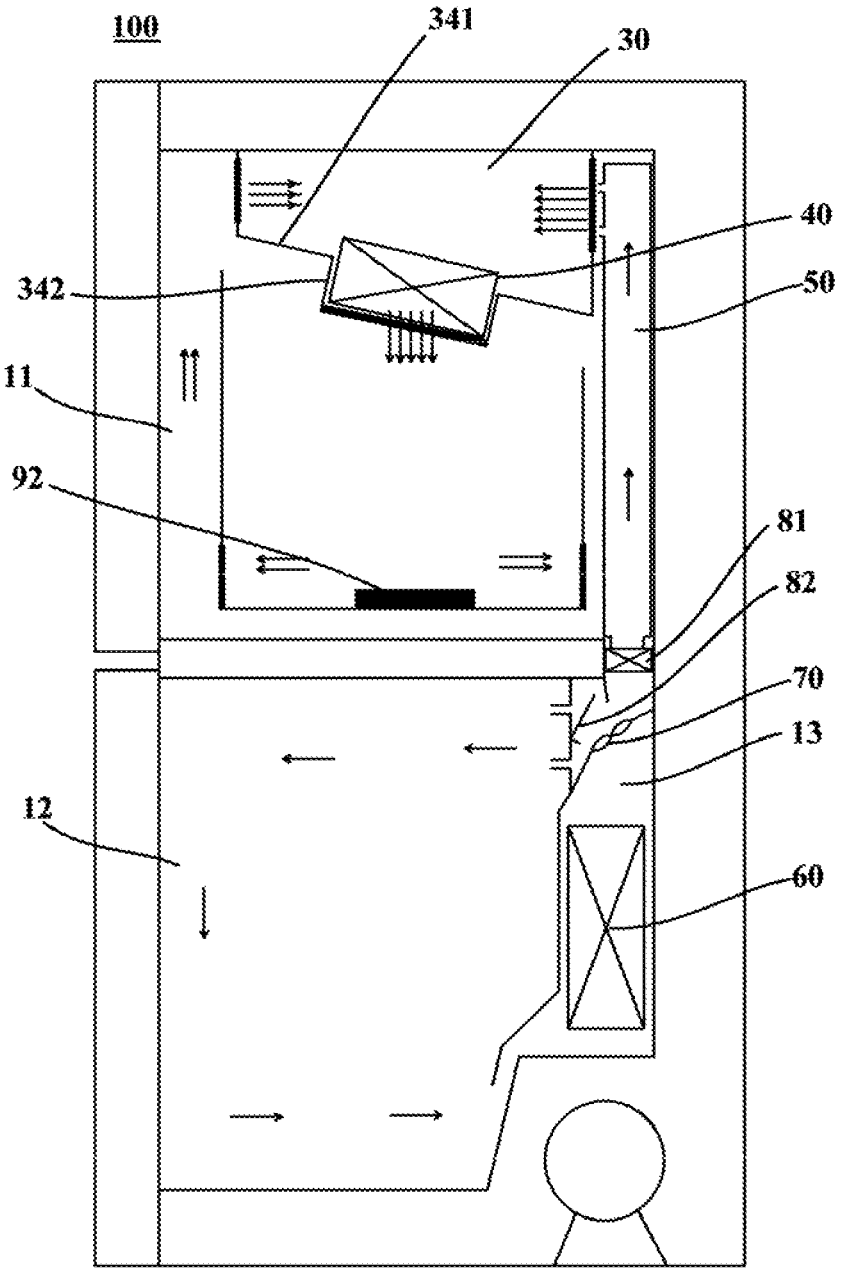
FIG. 2 is a schematic view of a refrigerator according to another embodiment of this invention.

In some embodiments of this invention, as shown in FIG. 2, the refrigerator 100 may further comprise another storage compartment 12, which may be arranged blow the storage compartment 11. For example, the storage compartment 11 may be a refrigeration compartment, and the another storage compartment 12 may be a freezing compartment. Further, a quick freezing compartment may be provided between the storage compartment 11 and the another storage compartment 12.

The refrigerator 100 may further comprise a cooling chamber 13, a cooling device 60 and a blower 70. The cooling chamber 13 in the embodiments of this invention may be arranged behind the another storage compartment 12. The cooling chamber 13 is provided with an air outlet connected with the refrigeration air passage 50. The cooling device 60 is provided in the cooling chamber 13 to cool the air passing the cooling chamber. The cooling device 60 may be an evaporator of a compression refrigeration system. The blower 70 may be arranged at the air outlet. The outlet of the return air passage may connect the cooling chamber 13. The refrigerator 100 further comprises another refrigeration air passage connecting the air outlet of the cooling chamber 13 and the another storage compartment 12, and another return air passage connecting the another storage compartment 12 and the cooling chamber 13. In some alternative embodiments of this invention, both the refrigeration air passage 50 and the return air passage communicate with the another storage compartment 12, namely, the freezing compartment, instead of the cooling chamber 13, so as to utilize the refrigeration output in the cooling chamber.

In some embodiments of this invention, the refrigerator 100 may further comprise an air door 81 and a movable air supply hood 82. The air door 81 is configured to controllably close or open the refrigeration air passage 50. The movable air supply hood 82 is provided at an outer side of the air outlet of the cooling chamber 13 and configured to provide an opening allowing refrigeration air to flow into the refrigeration air passage 50 when closing the air outlet of the cooling chamber 13. That is, when the movable air supply hood 82 closes the air outlet of the cooling chamber 13, the another refrigeration air passage connected with the another storage compartment 12 can be closed, so that the refrigeration air passage 50 is not blocked.

The refrigerator 100 of the embodiments of this invention may have multiple working modes. The multiple working modes may comprise the following working modes: an independent working mode of the storage compartment 11, an independent working mode of the another storage compartment 12, a joint working mode, a quick refrigeration mode and another joint working mode. In the independent working mode of the storage compartment 11, the movable air supply hood 82 is closed, the air door 81 is opened, the blower 70 works while the mixed air blower 40 does not work, so that the storage compartment 11 works independently. In the independent working mode of the another storage compartment 12, the movable air supply hood 82 is opened, the air door 81 is closed, the blower 70 works while the mixed air blower 40 does not work, so that the another storage compartment 12 works independently. In the joint working mode, the movable air supply hood 82 is opened, the air door 81 is opened, the blower 70 works while the mixed air blower 40 does not work, so that the two storage compartments 11, 12 work jointly. In the quick refrigeration mode, the movable air supply hood 82 is closed, the air door 81 is opened, and both the blower 70 and the mixed air blower 40 work, so that quick refrigeration can be performed in the storage compartment 11. As shown in FIG. 1, the arrows in this figure represent the flow directions of air flow. To prevent excessive temperature rise in the another storage compartment 12, after the quick refrigeration mode operates for a certain period, the refrigerator automatically exits from this mode. In the another joint work mode, the movable air supply hood 82 is opened, the air door 81 is opened, and both the blower 70 and the mixed air blower 40 work, so that quick refrigeration can be performed in the storage compartments 11, 12. As shown in FIG. 2, the arrows in this figure represent the flow directions of air flow.

Although multiple embodiments of this invention have been illustrated and described in detail, those skilled in the art may make various modifications and variations to the invention based on the content disclosed by this invention or the content derived therefrom without departing from the spirit and scope of the invention. Thus, the scope of this invention should be understood and deemed to include these and other modifications and variations.

What is claimed is:

1. A refrigerator, comprising:

a storage compartment;

a mixed air passage, whose both ends have air inlets, whose middle portion comprises a mixed air outlet communicating with the storage compartment, and which is configured to receive air flows from the two air inlets such that two air flows enter the storage compartment in a mixed manner via the mixed air outlet;

a mixed air blower configured to blow the two air flows to the storage compartment in a mixed manner; and a mixed air passage cover plate mounted at a top wall of the storage compartment to form the mixed air passage, wherein the mixed air passage extends longitudinally and comprises the air inlets at its front and rear ends, wherein the mixed air passage cover plate is mounted on a lower surface of the top wall of the storage compartment, and comprises: a web portion extending upwards from a rear end of the web portion to a front end thereof and comprising a through hole at the center thereof, and an air aperture portion extending downwards in a direction perpendicular with the web portion from an edge of the through hole and having a lower end opening acting as the mixed air outlet.

2. The refrigerator of claim 1, wherein the mixed air blower is an axial blower and is mounted inside the air aperture portion.

3. The refrigerator of claim 1, wherein an included angle between the web portion and the horizontal plane is between 5 and 30 degrees.

4. The refrigerator of claim 1, further comprising: a drawer which is mounted inside the storage compartment and lower portions of whose front and rear walls comprise ventilation holes.

5. The refrigerator of claim 1, further comprising: a refrigeration air passage, wherein one air inlet of the mixed air passage is configured to receive a refrigeration air flow blown from the refrigeration air passage, and another air inlet of the mixed air passage communicates with the storage compartment.

6. The refrigerator of claim 5, further comprising: a refrigeration air passage cover plate mounted at a front surface of a rear wall of the storage compartment to form the refrigeration air passage, and provided with at least one rear air outlet; or a refrigeration air passage cover plate mounted at a rear surface of the rear wall of the storage compartment to form the refrigeration air passage, the rear wall of the storage compartment being provided with at least one rear air outlet; wherein the at least one rear air outlet is configured to blow the refrigeration air flow to the one air inlet of the mixed air passage and/or to the storage compartment; and the another air inlet of the mixed air passage communicates with a front space of the storage compartment.

7. The refrigerator of claim 5, wherein a lower portion of the rear wall of the storage compartment comprises a return air opening such that a part or all of the air in the storage compartment flows out of the storage compartment via the return air opening and enters the refrigeration air passage after being cooled.

* * * * *